US007922566B2

(12) United States Patent
Chacko et al.

(10) Patent No.: US 7,922,566 B2
(45) Date of Patent: Apr. 12, 2011

(54) CUTTING HEAD FOR FLUID JET MACHINE WITH INDEXING FOCUSING DEVICE

(75) Inventors: Shajan V. Chacko, Joplin, MO (US); Duane C. Johnson, Joplin, MO (US); Jeffrey D. Stephens, Joplin, MO (US); Will C. Lambeth, Carthage, MO (US)

(73) Assignee: KMT Waterjet Systems Inc., Baxter Springs, KS (US)

( * ) Notice: Subject to any disclaimer, the term of this patent is extended or adjusted under 35 U.S.C. 154(b) by 784 days.

(21) Appl. No.: 11/888,688

(22) Filed: Aug. 2, 2007

(65) Prior Publication Data

US 2008/0032610 A1 Feb. 7, 2008

Related U.S. Application Data

(60) Provisional application No. 60/834,965, filed on Aug. 2, 2006.

(51) Int. Cl.
*B24C 5/04* (2006.01)

(52) U.S. Cl. ..... 451/102; 83/177; 239/433; 239/589

(58) Field of Classification Search ..... 83/177; 239/433, 589, 602; 451/102, 75, 101
See application file for complete search history.

(56) References Cited

U.S. PATENT DOCUMENTS

| | | | | | |
|---|---|---|---|---|---|
| 4,587,772 | A * | 5/1986 | Griffiths | ..... | 451/102 |
| 4,648,215 | A * | 3/1987 | Hashish et al. | ..... | 451/40 |
| 5,018,670 | A * | 5/1991 | Chalmers | ..... | 239/433 |
| 5,144,766 | A * | 9/1992 | Hashish et al. | ..... | 451/102 |
| 5,794,858 | A * | 8/1998 | Munoz | ..... | 239/433 |
| 5,851,139 | A * | 12/1998 | Xu | ..... | 451/102 |
| 6,932,285 | B1 * | 8/2005 | Zeng | ..... | 239/589 |
| 7,357,697 | B2 * | 4/2008 | Massa et al. | ..... | 451/102 |
| 2004/0107810 | A1 * | 6/2004 | Sciulli et al. | ..... | 83/177 |
| 2006/0223423 | A1 * | 10/2006 | Dorfman et al. | ..... | 451/38 |

* cited by examiner

*Primary Examiner* — Timothy V Eley

(74) *Attorney, Agent, or Firm* — Michael Best & Friedrich LLP

(57) ABSTRACT

A cutting head for a water jet cutting machine includes a base with a bore and an orifice member having an inlet, an outlet, and a passage extending between the inlet and outlet which increases velocity of fluid flowing through the passage to form a fluid jet. A wear insert has first and second ends, a passage extending between the two ends, the body second end being connected with the base and the body first end supporting the orifice member. A fluid focusing device includes a tubular body with a central passage having inlet and discharge ports, the tubular body being disposable within the base bore such that the body inlet port is fluidly coupleable with the orifice outlet. The tubular body and/or the base are/is configured such that the tubular body is separately positionable at one of a plurality of discrete, predetermined angular positions about the base bore axis.

52 Claims, 12 Drawing Sheets

CUTTING HEAD FOR FLUID JET MACHINE WITH INDEXING FOCUSING DEVICE

This application claims priority to U.S. Provisional Application Ser. No. 60/834,965, filed Aug. 2, 2006, the entire contents of which are incorporated herein by reference.

The present invention relates to high pressure fluid cutting machines, and more particularly to components for water jet cutting heads.

Fluid jet or "Water Jet" cutting machines are known and basically include an intensifier or similar device for highly pressurizing fluid (e.g., water) and a cutting head fluidly connected with the fluid intensifier and configured to direct a jet of high pressure fluid or fluid-abrasive mixture onto one or more work pieces. A cutting head typically includes a nozzle fluidly connected with the intensifier, an orifice member fluidly coupled with the nozzle and formed to restrict the flow and increase the velocity thereof so as to form a fluid jet, and a wear insert connected with a body and configured to mix the fluid jet with abrasive material.

Further, a cutting head also generally includes a focusing device disposed partially within the body so as to be fluidly coupled with the wear insert mixing chamber. The focusing device functions to restrict or focus the mixture of fluid and abrasive flowing from the mixture chamber and directs the high velocity jet flow onto a work piece to be cut thereby.

SUMMARY OF THE INVENTION

In one aspect, the present invention is a fluid focusing device for a cutting head of a waterjet cutting machine including a base with a bore having a central axis extending through the bore and an orifice member coupled with the base. The orifice member has an outlet and a passage for increasing velocity of fluid flowing through the passage so as to form a fluid jet discharged through the outlet. The focusing device comprises an elongated, generally cylindrical body with a central passage having an inlet port and a discharge port, the elongated body being at least partially disposable within the base bore such that the body inlet port is fluidly coupleable with the orifice outlet. The cylindrical body is configured so as to be separately positionable at each one of a plurality of discrete, predetermined angular positions about the base bore axis, the inlet port being at least generally aligned with the orifice member outlet at each one of the plurality of positions of the body about the axis. As such, the fluid jet flows from the orifice member outlet through the inlet port and into the central passage.

In another aspect, the present invention is a cutting head for a waterjet cutting machine comprising a base with a bore and a central axis extending through the bore. An orifice member is coupled with the base and having an inlet, an outlet, and a passage extending between the inlet and outlet, the passage being configured to increase velocity of fluid flowing through the passage so as to form a fluid jet discharged through the orifice outlet and generally toward the base bore. Further, a fluid focusing device includes a generally tubular body with a central passage having an inlet port and a discharge port, the tubular body being at least partially disposable within the base bore such that the body inlet port is fluidly coupleable with the orifice outlet. At least one of the tubular body and the base is configured such that the tubular body is separately positionable at one of a plurality of discrete, predetermined angular positions about the base bore axis. The body inlet port is at least generally aligned with the orifice member outlet at each one of the plurality of positions of the body about the axis such that the fluid jet flows from the orifice member outlet through the inlet port and into the central passage.

In a further aspect, the present invention is a wear insert for a cutting head of a water jet cutting machine. The cutting head includes a base with a bore, a generally tubular fluid focusing device disposed at least partially within the base bore and having a central passage with an inlet port and a discharge port, and an orifice member connected with the base and having a central passage and an outlet. The wear insert comprises a generally cylindrical body connectable with the base and having first and second ends, a passage extending between the body first and second ends, and an outlet at the body second end, the body outlet being disposed generally proximal to the tubular body inlet. Further, the body first end is configured to support the orifice member such that fluid flow through the orifice member passage flows out of the orifice member outlet, through the insert body passage and the insert body outlet, and into focusing device inlet port.

In yet another aspect, the present invention is again a cutting head for a water jet cutting machine. The cutting head comprises a base with a bore and a fluid focusing device including a generally tubular body with a central passage having an inlet port and a discharge port, the tubular body being at least partially disposable within the base bore. An orifice member has a passage with an outlet, the passage being configured to increase velocity of fluid flowing through the passage so as to form a fluid jet discharged through the outlet. Further, a wear insert has a generally cylindrical body with first and second ends, a passage extending between the body first and second ends, and an outlet at the body second end. The wear body second end is connectable with the base such that the body outlet is disposed generally proximal to the tubular body inlet. Furthermore, the wear body first end is configured to support the orifice member such that the fluid jet from orifice member outlet flows through the insert body passage and the insert body outlet and into focusing device inlet port.

In an even further aspect, the present invention is once again a cutting head for a water jet cutting machine. The cutting head comprises a base with a mixing chamber having an outlet and a bore aligned with the chamber outlet and having a central axis extending through the bore. A generally tubular body with a central passage has an inlet port and a discharge port, the tubular body being disposable within the base bore such that the body inlet port is fluidly coupleable with the mixing chamber outlet, at least one of the tubular body and the base being configured to indicate the angular position of the tubular body about the base bore axis.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings.

DETAILED DESCRIPTION OF THE INVENTION

Figure 1:
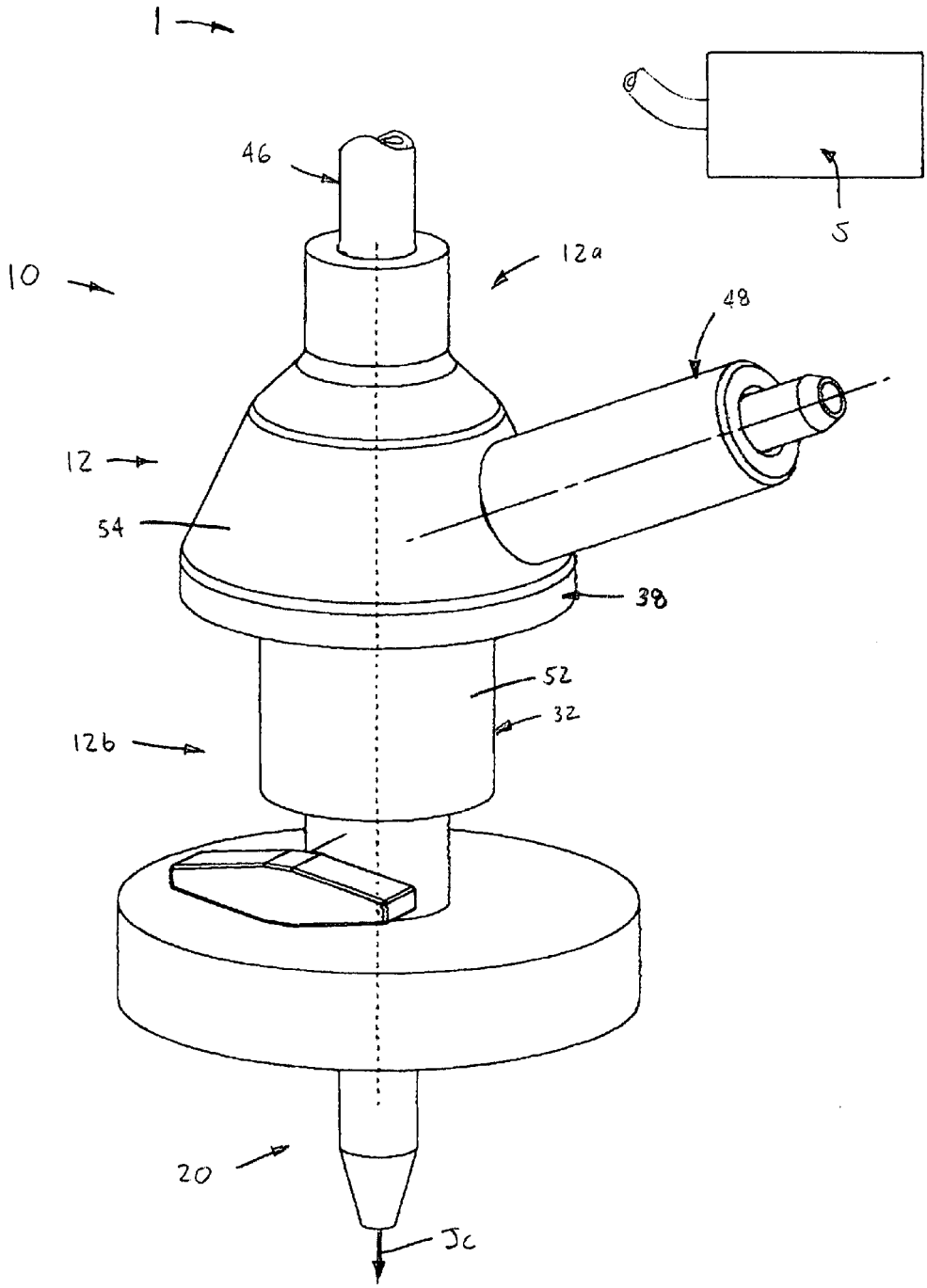
FIG. 1 is perspective view of a cutting head in accordance with the present invention.

Certain terminology is used in the following description for convenience only and is not limiting. The words "upper", "upward", "down" and "downward" designate directions in the drawings to which reference is made. The words "inner", "inwardly" and "outer", "outwardly" refer to directions toward and away from, respectively, a designated centerline or a geometric center of an element being described, the particular meaning being readily apparent from the context of the description. Further, as used herein, the word "connected" is intended to include direct connections between two members without any other members interposed therebetween and indirect connections between members in which one or more other members are interposed therebetween. The terminology includes the words specifically mentioned above, derivatives thereof, and words of similar import. Furthermore, throughout the following text, reference is made to two or more positions of various elements being described, and such positions are depicted in the drawing figures by indicating the relative positions of a single point on such elements. Such element points shown in the drawings are selected for convenience only and have no particular relevance to the present invention.

Referring now to the drawings in detail, wherein like numbers are used to indicate like elements throughout, there is shown in FIGS. 1-22 a cutting head 10 for a fluid stream or jet cutting machine 1, preferably a "water jet" cutting machine 1. The cutting head 10 comprises a base 12 and an orifice member 11 connected with the base 12 and configured to substantially increase fluid velocity or "focus" fluid F into a fluid jet $J_F$. The base 12 has first and second ends 12*a*, 12*b*, respectively, and a bore 18 extending within the base 12 generally between the two ends 12*a*, 12*b*, the bore 18 having a central axis 18*a*. The orifice member 11 has an outlet port 11*a* aligned with the base bore 18 (i.e., axially aligned) such that the fluid jet $J_F$ is directed generally toward and/or into the bore 18. The cutting head 10 also comprises a focusing device 20 comprising an elongated, generally cylindrical body 22 with upper and lower ends 22*a*, 22*b*, a central passage 24 extending between the two ends 22*a*, 22*b*, and axis 21 extending centrally through the passage 24. The focusing device passage 24 has an inlet port 26 located at the body first end 22*a* and a discharge port 28 located at the body second end 22*b*. Further, the focusing device body 22 is disposable within the base bore 18 such that the body inlet port 26 is fluidly coupleable the orifice member outlet 11*a*. The focusing body 22 is configured so as to be separately positionable at one of a plurality of discrete, predetermined angular positions $P_n$ (e.g., $P_1$, $P_2$, $P_3$, $P_4$, etc.) about the base bore axis 18*a*. Preferably, the elongated body 22 has a plurality of indexing surfaces 23 engageable with the base 12 so as to position the body 22 separately at each one of the predetermined angular positions $P_n$, as described in further detail below.

More specifically, the base 12 is connectable with a source S of high-pressure fluid (e.g., an intensifier), as described below, and preferably includes an interior mixing chamber 14 connectable with a source of abrasive material (not shown) and a chamber outlet passage 16 fluidly connectable with the focusing body passage 24. As such, fluid F flows into the base 12 and is directed into the orifice member 11, is focused into a fluid jet $J_F$, and then flows through the mixing chamber 14 so as to entrain abrasive material $A_M$ to form a "mixed" fluid flow $F_M$ (i.e., fluid jet $J_F$ and abrasive material). Thereafter, the mixed fluid flow $F_M$ flows out of the chamber outlet passage 16 and into the focusing device passage 24. The focusing body inlet port 26 is generally alignable with orifice member outlet 11*a* such that the mixed fluid flow $F_M$ flows generally centrally into the focusing body passage 24. The body 22 is adjustably angularly positionable about the bore axis 18*a* to vary sections of the inlet port 26 contactable by the fluid flow $F_M$ such that wear from misalignment between the orifice outlet port 11*a* and the body inlet port 26 is generally distributed about the inlet port circumference $C_P$. More specifically, the orifice member outlet 11*a* and the focusing device inlet port 26 are ideally perfectly coaxially aligned, such that mixed flow $F_M$ is distributed evenly across the focusing device inlet port 26 so that abrasive material $A_M$ entrained in the flow $F_M$ evenly contacts a radial end surface 31*a* and an inner circumferential surface 41 defining the inlet 26 and the central passage 24.

Figure 5:
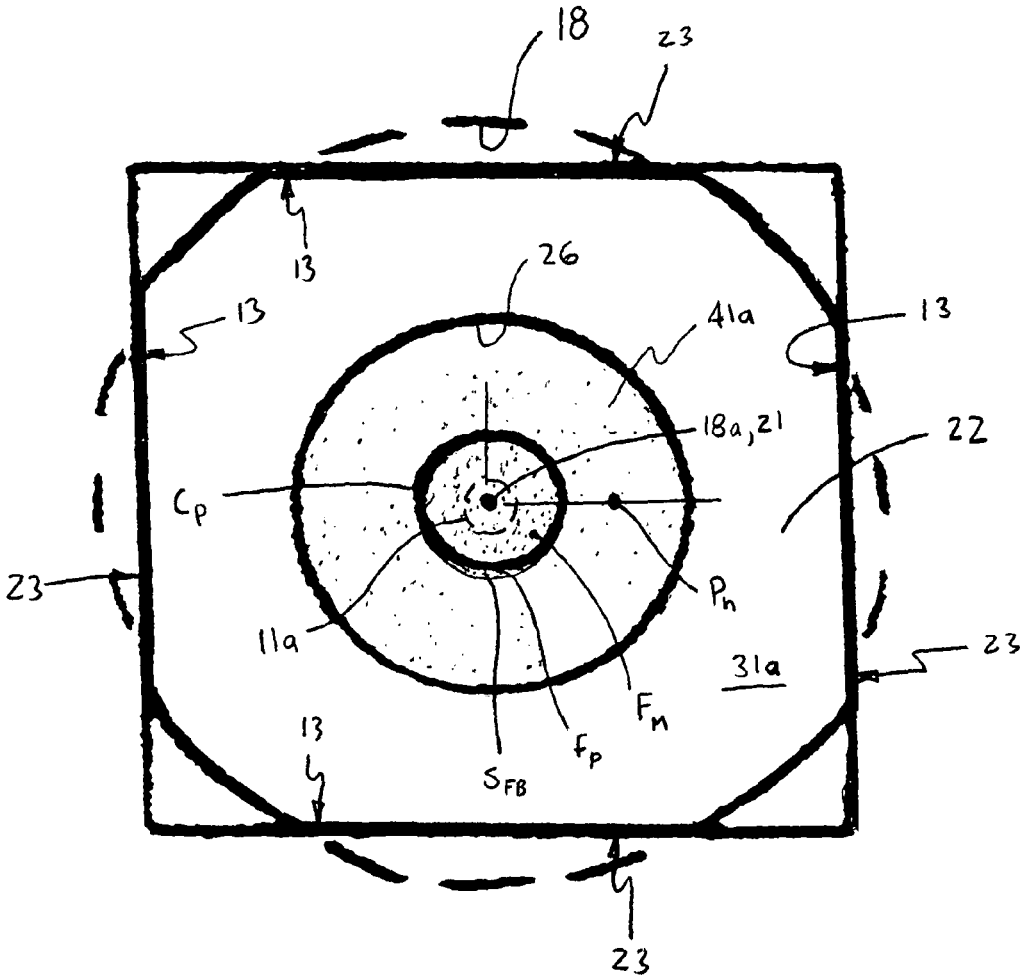
FIG. 5 is an enlarged, more diagrammatic top plan view of an inlet port of the fluid focusing device and an orifice member outlet (in phantom), showing an exaggerated misalignment between the two components for purposes of illustration.
Figure 6A:
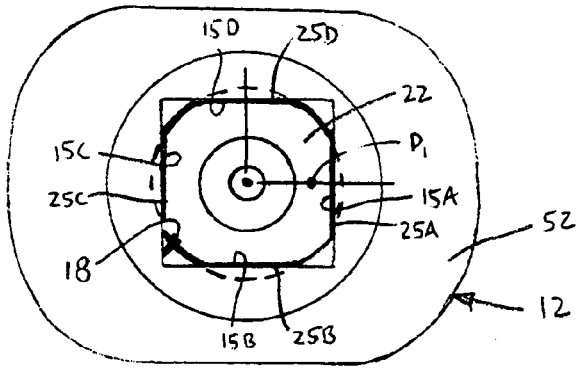
FIGS. 6A-6D, collectively FIG. 6, each show a different angular position of the focusing device within the support body.
Figure 6B:
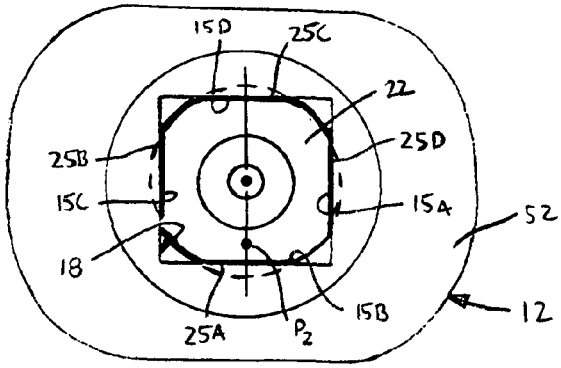
Figure 6C:
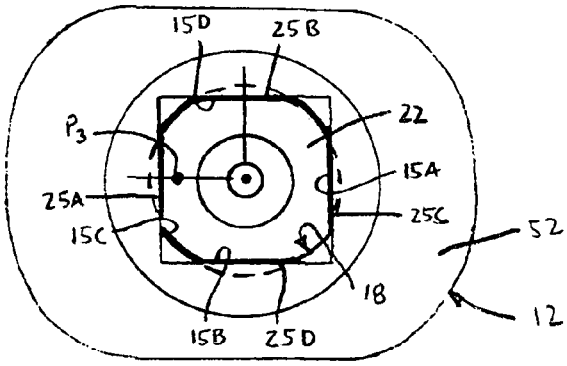
Figure 6D:
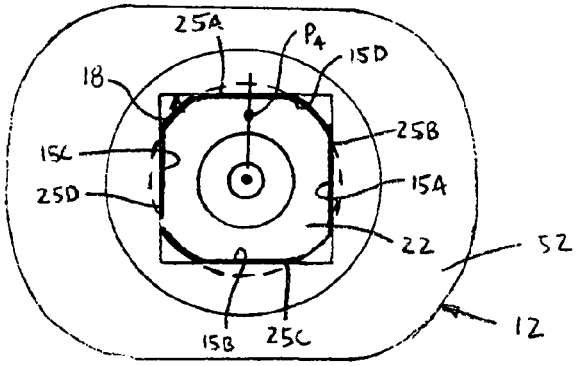

However, in reality there is often a slight misalignment between the two ports 11*a*, 26, such that an "offset" portion $f_P$ of the entrained abrasive material $A_M$ within the mixed flow $F_M$ contacts one section $S_{FB}$ of the focusing body 22 to a greater extent than the remainder of the body 22, as depicted in FIG. 5. As such, the focusing body section $S_{FB}$ experiencing contact by the offset flow portion $f_P$ is subjected to much greater wear from the very high pressure flow F as compared with other sections of the body 22. Therefore, to prolong the useful life of the focusing device 20, the cylindrical body 22 may be periodically removed from the base bore 18 and partly or incrementally rotated about the bore axis 18*a* to "present" a different section $S_{FB}$ of the focusing body 22 to the offset flow portion $f_P$, as discussed in greater detail below.

To facilitate such incremental positioning of the focusing device 20, the cutting head base 12 preferably has at least one locator surface 13 disposed at a specific angular position about the bore axis 18*a* and the focusing body 22 has at least two indicator surfaces 23, specifically first and second indexing surfaces 25A, 25B each separately disposable generally against the locator surface(s) 13. The indexing surfaces 23 are located on the body 22 such that the first indexing surface 23A is disposed against the at least one locator surface 13 when the focusing body 22 is located at a first angular position $P_1$ about the bore axis 18*a*. The second indexing surface 23B is disposed against the at least one locator surface 13 when the body 22 is located at a second angular position $P_2$ about the bore axis 18*a*. Such contact between the focusing device indexing surfaces 23 and the base locator surface(s) 13 both locates the body 22 at a particular position within the bore 18 and prevents rotation of the focusing body 22 about the bore axis 18*a* (and thus also the body axis 21).

Figure 10:
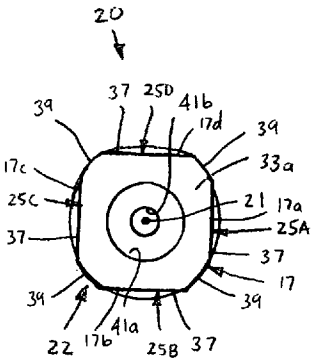
FIG. 10 is a top plan view of the focusing device.
Figure 9:
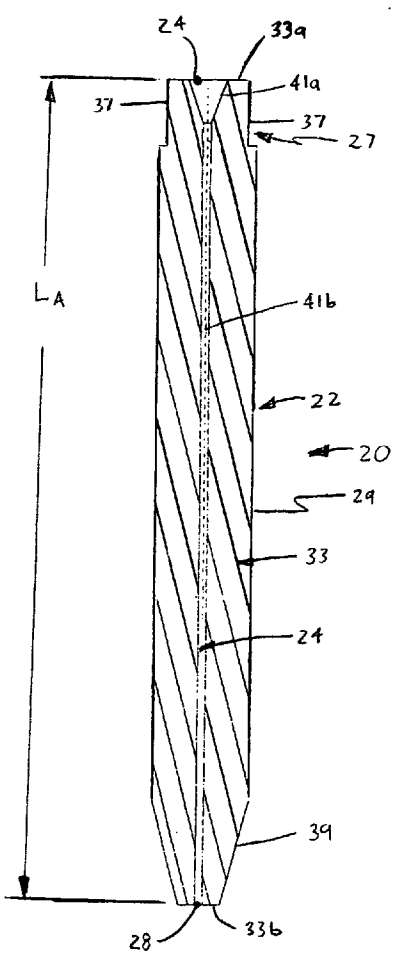
FIG. 9 is an axial cross-sectional view of the focusing device.
Figure 8:
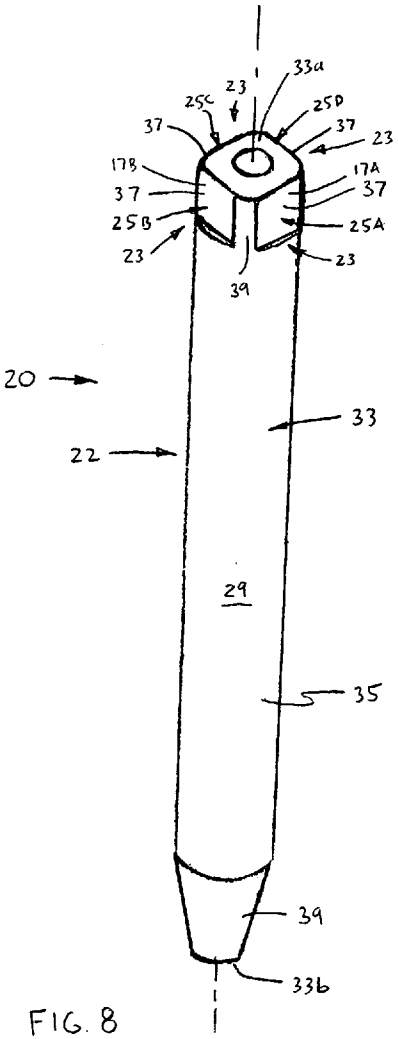
FIG. 8 is a perspective view of the fluid focusing device.

As best shown in FIGS. 6, 8 and 10, the focusing body 22 preferably has a plurality of at least three indexing surfaces 23 and most preferably four surfaces 25A, 25B, 25C, 25D spaced circumferentially about the body axis 21. The preferred four indexing surfaces 23 are preferably evenly spaced in equal angular increments about the axis (e.g., ninety degrees (90°) apart). With such a focusing device structure, the base 12 preferably has four locator surfaces 15A, 15B, 15C, 15D spaced circumferentially apart about the bore axis 18*a*, also preferably evenly spaced in ninety degree (90°) angular increments. As such, each indexing surface 23 is disposable against a separate one of the locator surfaces 13 when the focusing device 20 is disposed within the bore 18, as follows.

Referring particularly to FIG. 6, as the number (e.g., four) of the indexing surfaces 23 is equal to the number of the locator surfaces 13, each indexing surface 23 is disposed against a particular one of the locator surfaces 13 in one of the predetermined angular positions $P_n$ (e.g. $P_1$) and alternatively disposed against another one of the locator surfaces 13 in another one of the predetermined angular positions $P_n$ (e.g. $P_2$). More specifically, in a first preferred position $P_1$, the first indexing surface 25A is disposed against a first locator surface 15B, the second indexing surface 25B is disposed against the second locator surface 15B, a third indexing surface 25C is disposed against a third locator surface 15C, and a fourth indexing surface 25D is disposed against a fourth locator surface 15D (see FIG. 6A). Alternatively, in a second position $P_2$, at which the body 22 has been rotated ninety degrees (90°) about its axis 21 from the first position $P_1$, the first indexing surface 25A is disposed against the second locator surface 15B, the second indexing surface 25B is disposed against the third locator surface 15C, the third indexing surface 25C is disposed against the fourth locator surface 15D, and the fourth indexing surface 25D is disposed against the first locator surface 15A, as shown in FIG. 6B Furthermore, in third and fourth angular positions $P_3$, $P_4$ each respectively spaced one hundred eighty degrees (180°) and two hundred seventy degrees (270°) from the first position $P_1$, the indexing surfaces 23 and locator surfaces 23 contact each other in the following pairs: 25A/15C, 25B/15D, 25C/15A, 25D/15B (FIG. 6C) and 25A/15D, 25B/15A, 25C/15B, 25D/15C (FIG. 6D).

Although the above "rectangular" structure is presently preferred, the cutting head base 12 and focusing device 20 may be constructed with any number of mating surfaces 13, 23. For example, the base 12 and focusing body 22 may be formed with three locator surfaces 15A, 15B, 15C and three indexing surfaces 23A, 23B, 23C, respectively, such that the body 22 is locatable at three different angular positions $P_1$, $P_2$, $P_3$ spaced one hundred twenty degrees (120°) apart (structure not shown). Further for example, the base 12 and focusing body 22 may be formed respectively with five locator surfaces 15A, 15B, 15C, 15D, 15E and five indexing surfaces 23A, 23B, 23C, 23D, 23E, such that the body is locatable at five different angular positions $P_1$, $P_2$, $P_3$, $P_4$, $P_5$ spaced seventy-two degrees (72°) apart (not shown). Furthermore, the cutting head base 12 and the focusing device 20 may alternatively be formed such that the number of indexing surfaces 23 may differ from the number of locator surfaces 13; for example, the focusing body 22 may have six indexing surfaces 23 mateable or engageable with three locator surfaces 13 of the base 12. The scope of the present invention encompasses these and all other desired constructions of the base locator surfaces 13 and focusing device indexing surfaces 23.

Referring to FIGS. 8, 10, 14 and 16, the base bore 18 is preferably at least partially defined by a generally polygonal inner surface 17 extending circumferentially about the bore axis 21, which is most preferably generally rectangular, and further defined by a generally circular inner circumferential surface 19 extending about the bore axis 18*a* and axially between the polygonal surface 17 and the base second end 12*b*. The polygonal surface 17 has a plurality of surface sections 17*a*, 17*b*, 17*c*, 17*d* spaced circumferentially about the bore axis 18*a* and each providing a separate one of the locator surfaces 13 (i.e., surfaces 15A, 15B, 15C, 15D). Correspondingly, the focusing device body 22 has a generally polygonal outer surface 27 extending circumferentially about the body axis 21 and located proximal to the body upper end 22*a*, which is preferably generally rectangular with rounded corners, for reasons described below. Also, the body 22 has a generally circular outer circumferential surface 29 extending axially between the polygonal outer surface 27 and body second end 22*b*. Further, the focusing body polygonal outer surface 27 has a plurality of surface sections 27*a*, 27*b*, 27*c*, 27*d* spaced circumferentially about the body axis 21 and each providing a separate one of the indexing surfaces 23 (i.e., surfaces 25A, 25B, 25C, 25D). With such base and focusing device structures, the focusing body polygonal outer surface 27 is disposable generally within the base bore polygonal inner surface 17 when the focusing body 22 is disposed within the base bore 18, thereby mating the indexing and locator surfaces 23, 13 in specific pairs, as described in detail above. Furthermore, as best shown in FIGS. 2 and 7, the locator surfaces 13 are preferably spaced inwardly (and upwardly) from the base second, lower end 12*b* and the focusing body indexing surfaces 23 are located at least generally proximal to the focusing body first, upper end 22*a*.

Figure 2:
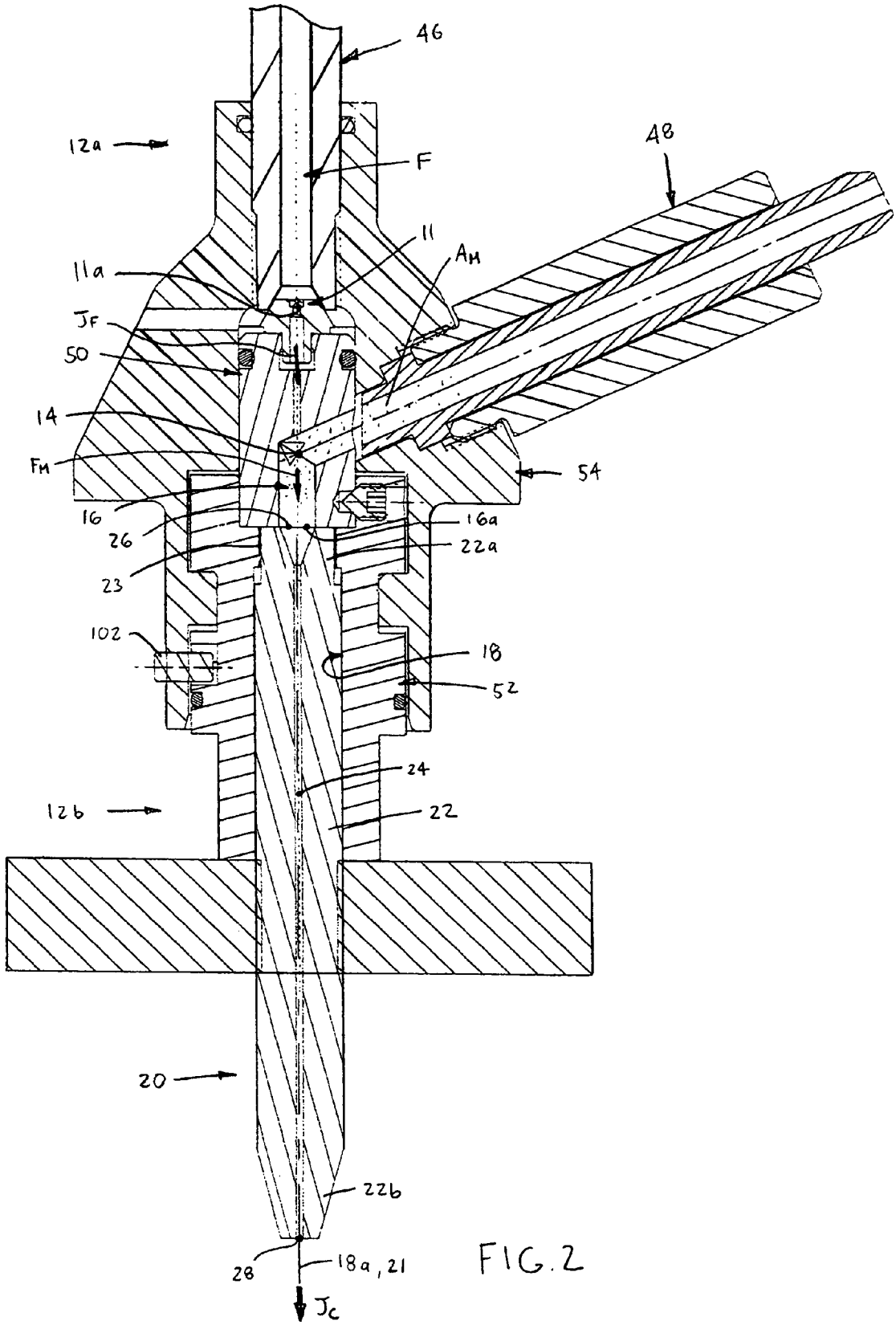
FIG. 2 is an axial cross-sectional view of the cutting head.
Figure 7:
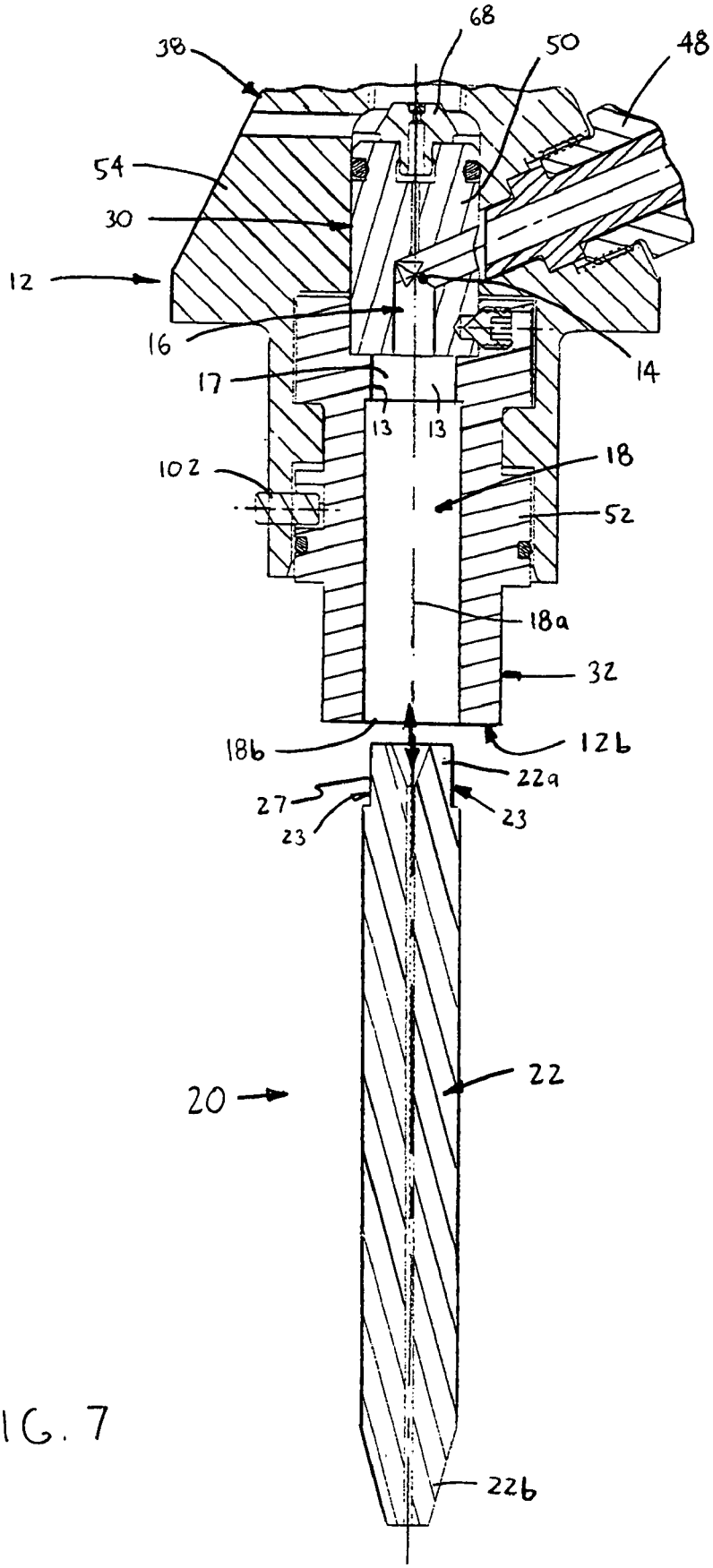
FIG. 7 is an axially cross-sectional view of a focusing device as positioned for insertion into, or removal from, the support body.

Referring to FIGS. 2, 6 and 7, with the above-described structure, the focusing device 20 is preferably installed within the cutting head base 12 by inserting the upper end 22*a* of the focusing device body 22 into the base bore 18 through an opening 18*b* at the base second end 12*b*, and the body 22 is linearly displaceable along the bore axis 18*a*. Then, the focusing device 20 is moved progressively deeper into the bore 18 until the body indexing surfaces 23/outer polygonal surface 27 are/is disposed within the bore locator surfaces 13/inner polygonal surface 17, a portion of the focusing body circular outer circumferential surface 29 being disposed generally within and in contact with the bore inner circumferential surface 19. Thereby, the focusing device 20 is located at one of the predetermined angular positions $P_n$ about the bore axis

18*a* by contact between corresponding locator surface/indexing surface pairs 13/23 for one of the particular position $P_n$, as described in detail above. Further, after a predetermined period of operation of the fluid cutting machine 1, the focusing device body 22 is preferably removed from the base bore 18 through the base second, lower end 12*b*, rotated about the body axis 21, and reinserted through the base second end 12*b* until the indexing surfaces 23 engage or contact the locator surfaces 13 to locate the body 22 at another predetermined angular position $P_n$ (e.g., mating in pairs 25A/15B, 25B/15C, 25C/15D, 25D/15A to position the body 22 at the second position $P_2$). Thus, the focusing device 20 may be sequentially incrementally positioned at each one of the predetermined positions $P_n$ so as to evenly distribute wear on the focusing device body 22 to thereby prolong the useful life thereof.

As best shown in FIGS. 6-8, the elongated cylindrical body 22 of the focusing device 20 is preferably generally formed of a single generally circular bar 33 with opposing first and second radial ends 33*a*, 33*b* and an outer circumferential surface 35 extending between the ends 33*a*, 33*b*. The bar 33 preferably has four flats 37 formed at the first, upper end 33*a*, such as by forging or cutting, and are preferably formed with a relatively minimal depth such that four rounded "corner" surface sections 39 remain between the flats 37. The four flats 37 each provide a separate one of the indexing surfaces 23 as described above. Further, the focusing body bar 33 preferably has a conical section 39 formed at the lower end 33*b* to facilitate placement of the fluid cutting jet $J_F$ projected out of the focusing device 20 during use of the cutting head 10. Furthermore, a through bore 41 is formed centrally in the bar 33 (e.g., by drilling) so as to extend between the two ends 33*a*, 33*b*. Preferably, the through bore 41 has an upper, generally conical inlet section 41*a* and a lower, generally constant diameter primary section 41*b*. The conical inlet section 41*a* is configured to receive the mixed fluid flow $F_M$ and to focus the entrained abrasive material $A_M$ in the flow $F_M$ into the primary bore section 41*b*, which has a relatively small diameter such that the flow $F_M$ through the passage 24 becomes focused (i.e., the entrained abrasive material $A_M$ of the flow $F_M$) into a high pressure cutting jet $J_C$, as indicated in FIGS. 1 and 2 Also, the bar 33 is preferably sized with an axial length $L_A$ such that when the focusing device 20 is installed within the base 12, a portion of the body 22 extends outwardly from the base 12 such that the body second end 22*b* is spaced from the base second end 12*a*.

Referring now to FIGS. 1, 2, 7 and 12-18, the cutting head base 12 is preferably an assembly that includes at least two base portions 30, 32; specifically, a first, upper base portion 30 removably connected with a second base portion 32, configured to support the orifice member 11, and including the mixing chamber 14 and the chamber outlet passage 16, and a second, lower base portion 32 including the base bore 18. Each base portion 30, 32 has a first, upper end 30*a*, 32*a*, respectively, and a second, lower end 30*b*, 32*b*, respectively, and the two base portions 30, 32 are coupled, preferably removably, by connecting the first portion lower end 30*b* with the second portion upper end 32*a*, such that the first portion upper end 30*a* is spaced from (i.e., above) the second base portion 32. Preferably, the first base portion 30 also includes a jet inlet passage 34 with an inlet port 34*a* fluidly connectable with the orifice outlet port 11*a* and an abrasive material flow passage 36 with an inlet port 36*a*, each of the two passages 34, 36 being fluidly connected with the mixing chamber 14. Further, the cutting head base 12 preferably further includes a third base portion 38 removably connected with at least one of the first and second base portions 30, 32, the third base portion 30 including a cavity 40 configured to receive the first base portion 32 and at least a portion of the second base portion 30. The third base portion 38 includes a nozzle bore 42 at least generally alignable and/or fluidly coupleable with the jet inlet passage 34 and an abrasive flow bore 44 at least generally alignable with the abrasive flow passage 36.

With such a base structure, the cutting head 10 preferably further comprises a fluid supply nozzle 46 and an abrasive supply tube 48. The fluid supply nozzle 46 is fluidly connected with the high pressure source S and is at least partially disposed within the nozzle bore 42. The nozzle 46 has a flow passage 47 with an outlet 49 fluidly coupleable with an orifice member inlet port 11*b*, as discussed in greater detail below. Furthermore, the abrasive supply tube 48 is fluidly connected with a source of abrasive material (not shown) and is at least partially disposed within the abrasive flow bore 44. The abrasive supply tube 48 includes a flow passage 49 with an outlet 51 fluidly coupleable with the abrasive material flow passage 36 of the second base portion 32, as is also described further below.

Figure 11:
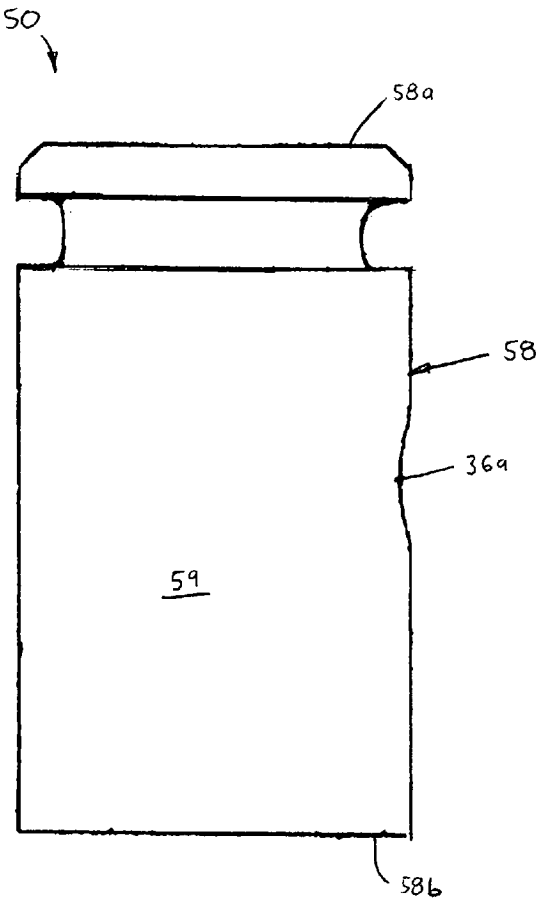
FIG. 11 is an enlarged, side elevational view of the wear insert.
Figure 12:
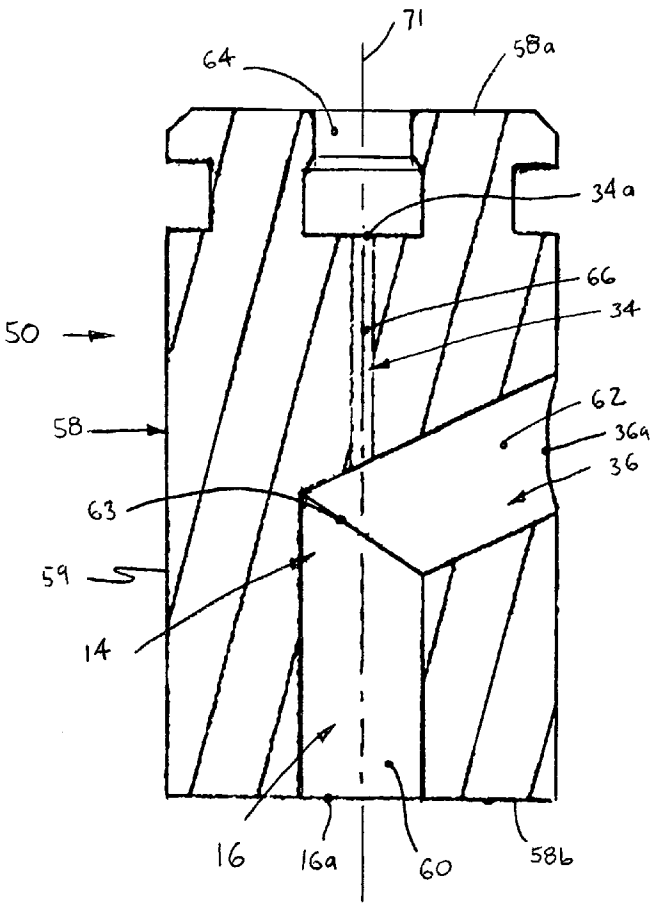
FIG. 12 is an enlarged, axial cross-sectional view of the wear insert of FIG. 11.
Figure 13:
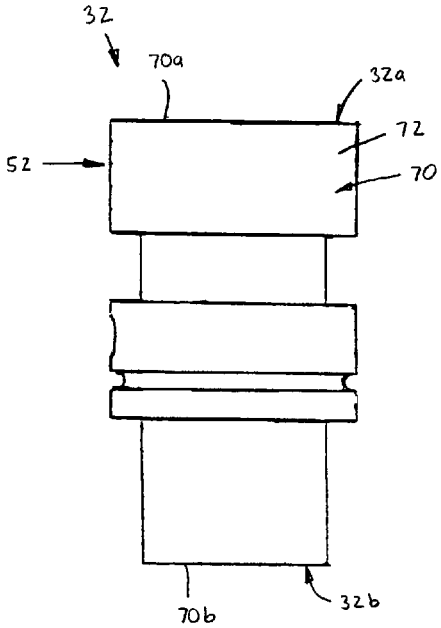
FIG. 13 is a side elevational view of a support body.
Figure 14:
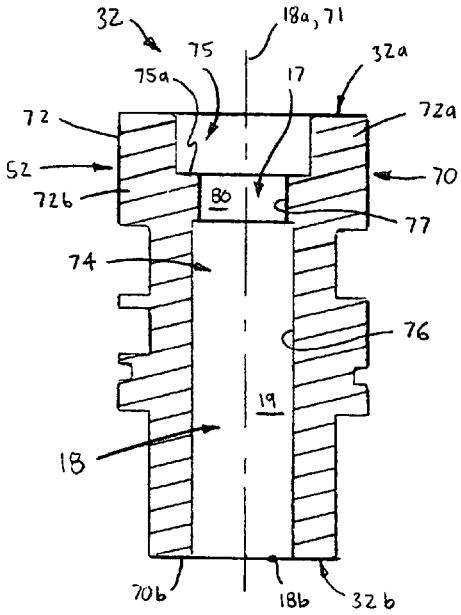
FIG. 14 is an axial cross-sectional view of the support body.
Figure 15:
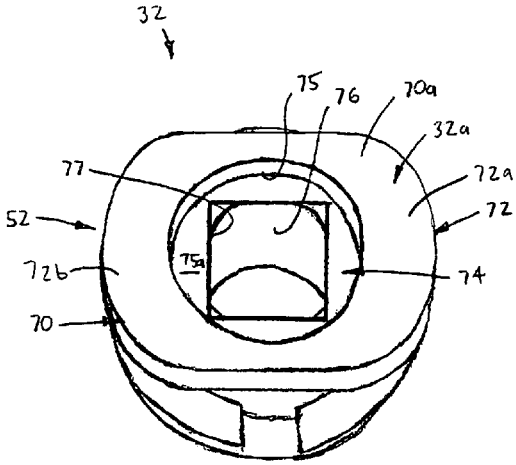
FIG. 15 is a top perspective view of the support body.
Figure 16:
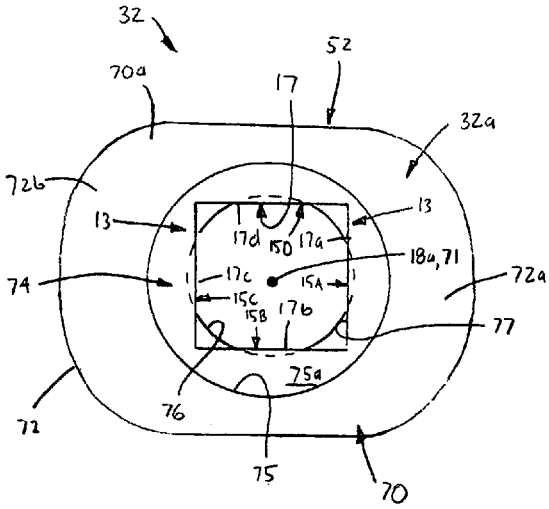
FIG. 16 is a top plan view of the support body.

Most preferably, the cutting head 10 comprises a wear insert 50 providing the first base portion 30, a support body 52 providing the second base portion 32, and a cap member 54 providing the third base portion 38, as follows. Referring first to FIGS. 11 and 12, the wear insert 50 preferably includes a generally cylindrical body 58 having first and second radial ends 58*a*, 58*b*, respectively, and an outer circumferential surface 59. A first, generally axial bore 60 extends inwardly from the body second end 58*b* and provides the mixing chamber outlet passage 16, and a second, angled radial bore 62 extends inwardly from the outer circumferential surface and provides the abrasive flow passage 36. The two bore sections 60, 62 intersect at a bore section 63 within the body 58 to form the mixing chamber 14. Further, a generally circular cylindrical mounting cavity 64 extends inwardly from the body first end 58*a* and is configured to receive a portion of an orifice member 68 (described below). Also, a relatively narrower or smaller diameter hole 66 extends between the mounting cavity 64 and the bore intersection 63 and provides the jet inlet passage 34. The jet hole 66 is sized (i.e., diametrically) such that the jet inlet passage 34 permits the fluid jet $J_F$ flowing from the orifice member 11 to pass therethrough with clearance.

Referring now to FIGS. 13-16, the support body 52 includes a generally circular cylindrical main body 70 having first and second ends 70*a*, 70*b*, a body axis 71 extending between the two ends 70*a*, 70*b*, a generally rectangular mounting portion 72 at the body first end 70*a*, and stepped throughhole 74 extending between the two ends 70*a*, 70*b*. The stepped through hole 74 includes a generally circular mounting cavity section 75 extending inwardly from the body first end 70*a* and is configured to receive at least a portion of the wear insert body second end 58*b*, as described below. A generally circular, primary hole section 76 extends inwardly from the body second 70*b* along the axis 71*a* substantial portion of body length $l_B$, and a generally polygonal hole section 77 extends axially between the primary hole section 76 and the mounting cavity section 75, the primary hole section and the polygonal hole section collectively defining the mounting bore 18, with the bore axis 18*a* being substantially collinear with the body axis 71.

The polygonal hole section 77 is located generally proximal to the body first end 70*a*, and is defined by a generally polygonal inner surface 80 extending circumferentially about the bore axis 18*a*. The polygonal inner surface 80 is preferably generally rectangular, but may be triangular, hexagonal, etc., and provides the plurality of locator surfaces 13 (e.g., four surfaces 15A, 15B, 15C, 15D) spaced circumferentially about the bore axis 18*a*, as described in detail above. The mounting cavity section 75 is sized to receive a portion of the body second end 58*b* of the wear insert 50, such that the body lower end 58*b* is disposed upon a shoulder surface 75*a*, and is preferably releasably retained therein by a set screw 83 (see, e.g., FIG. 3) or similar means. As such, the wear insert second end 58*b* is connectable with the support body first end 70*a* such that the wear insert first end 50*a* is spaced from the support body 52 and the mixing chamber outlet passage 16 is fluidly connected with the focusing device passage 24 when the focusing body 22 is disposed within the bore 18. That is, the wear insert 50 is directly coupled with the support body 52 such that flow exiting the wear insert 50 through the passage outlet port 16*a* flows substantially directly into the focusing device inlet port 26.

Figure 3:
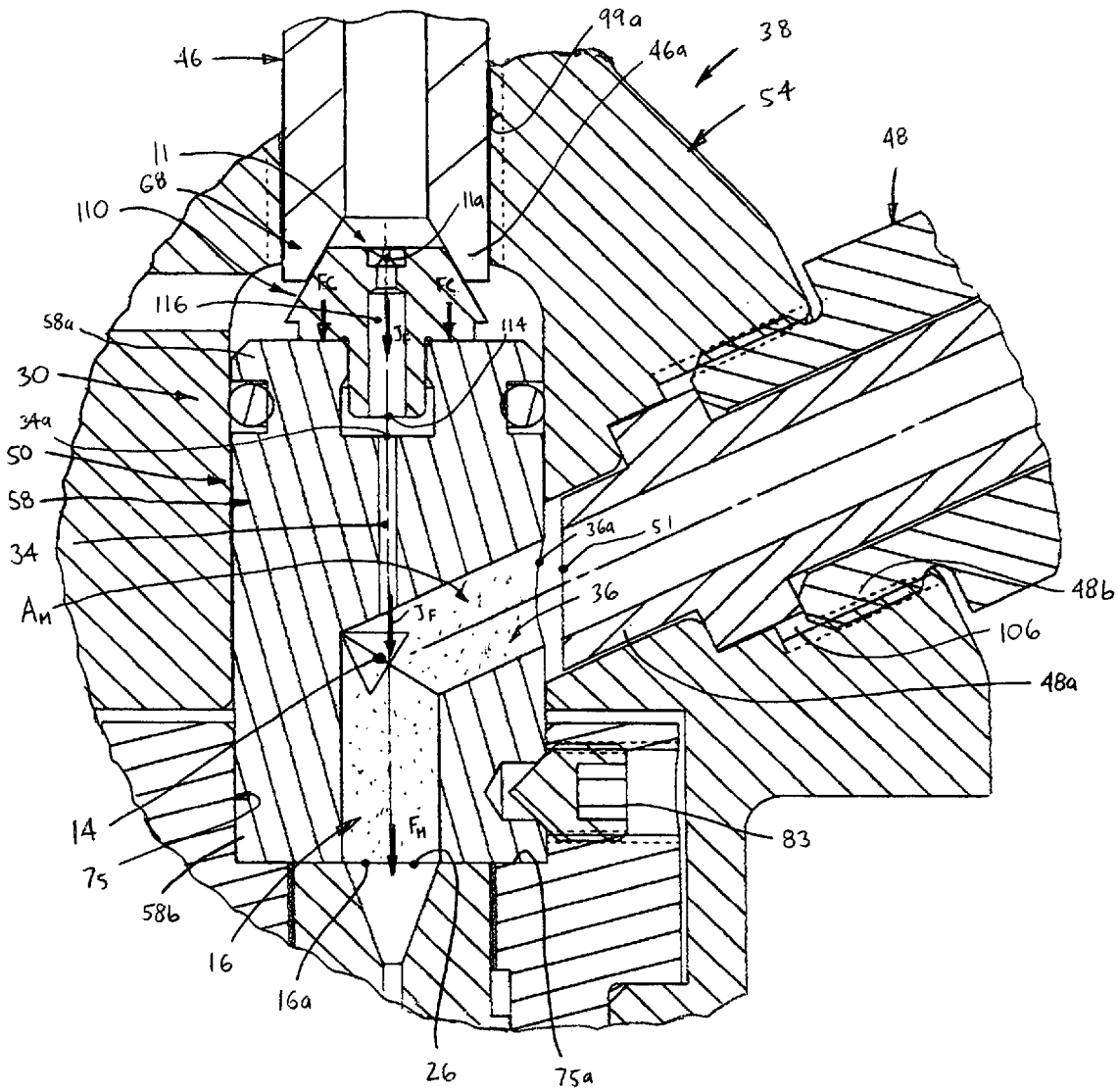
FIG. 3 is an enlarged, broken-away cross-sectional view of a central portion of the cutting head, showing the mixing of a fluid jet flow and an mixed flow of the fluid jet and entrained abrasive material.
Figure 4:
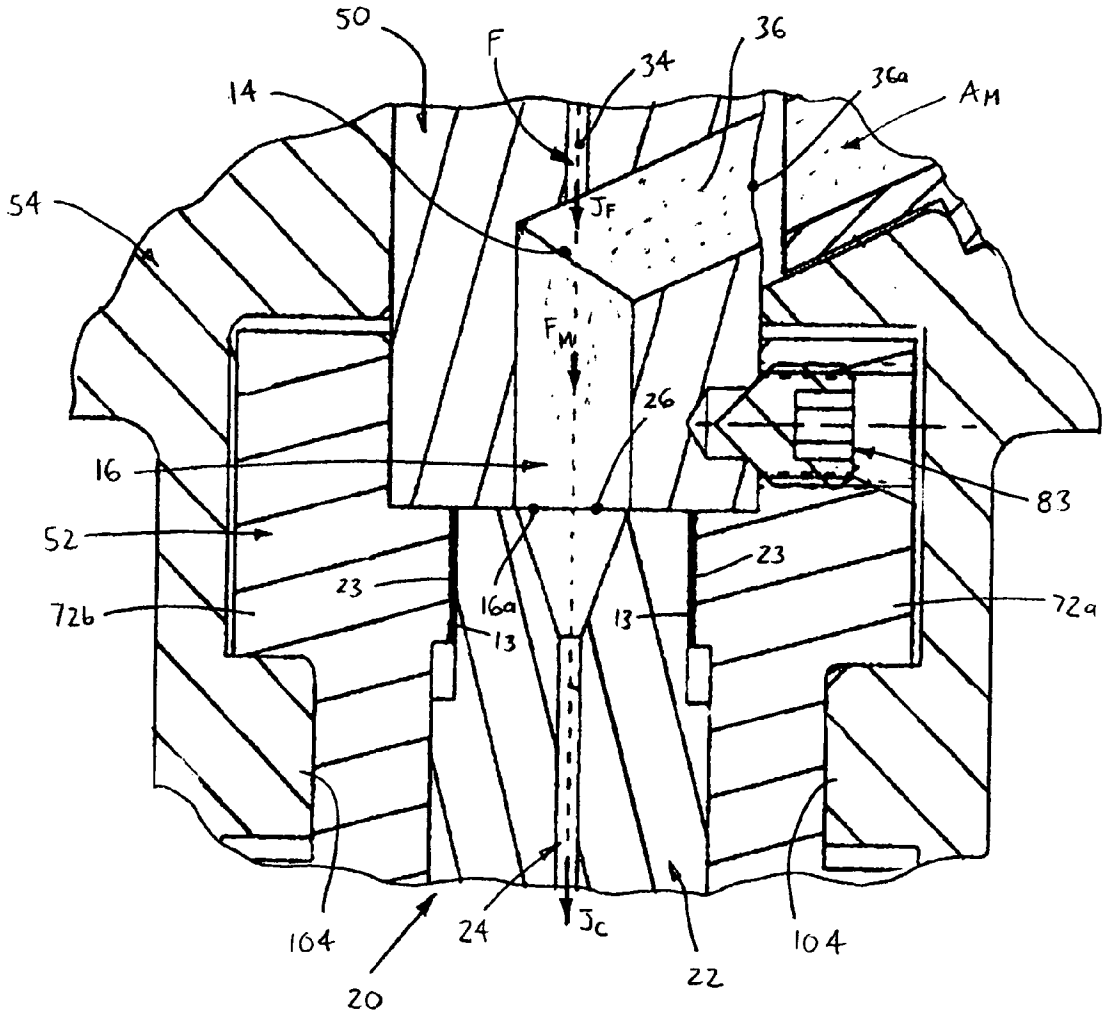
FIG. 4 is a more enlarged, broken-away cross-sectional view of a mixed flow from the mixing chamber flowing into a focusing device.
Figure 18:
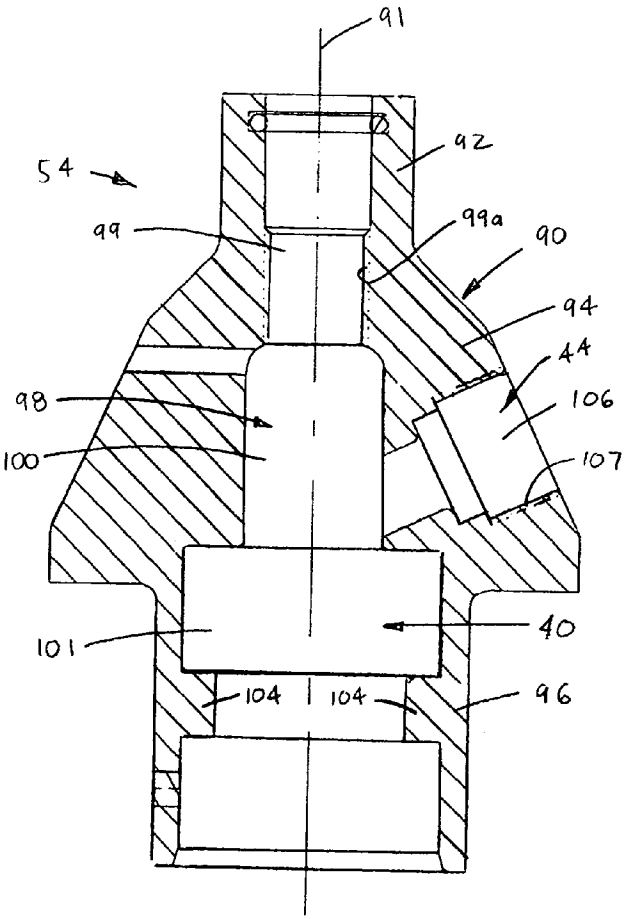
FIG. 18 is an axial cross-sectional view of the wear insert of FIG. 17.
Figure 17:
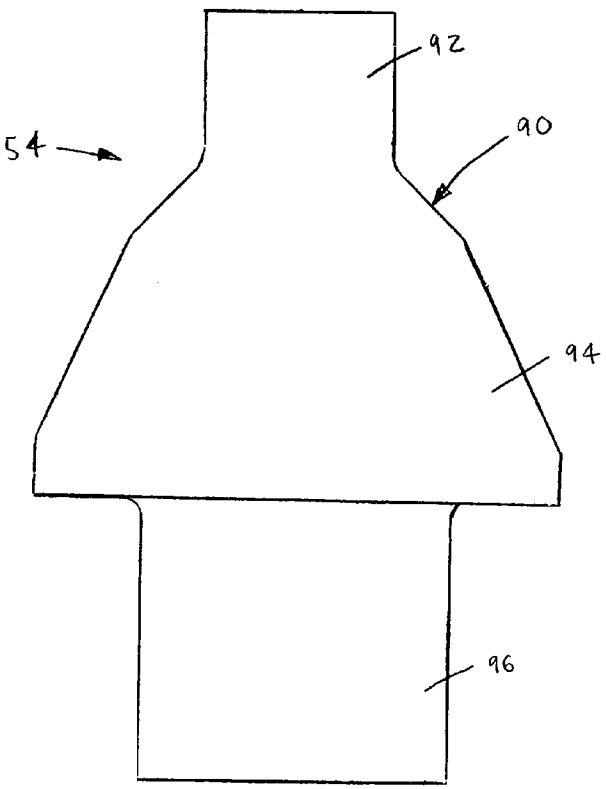
FIG. 17 is a side elevational view of a cap member.
Figure 20:
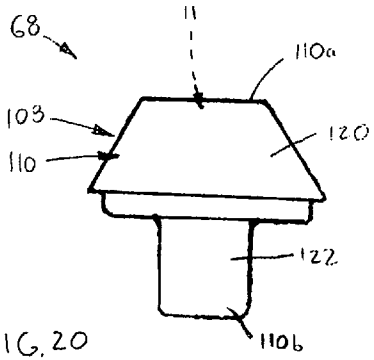
FIG. 20 is a more enlarged, side elevational view of the orifice assembly member.

Referring to FIGS. 3, 17 and 18, the cap member 54 includes a generally complex shaped body 90 having first and second ends 90*a*, 90*b* and a central axis 91 extending between the two ends 90*a*, 90*b*. The cap body 90 includes three sections spaced along the axis 91; specifically, a first, upper cylindrical end section 92, a second, generally frustoconical main section 94, and a third, lower cylindrical end section 96. A stepped through hole 98 extends through the body 90 between the two ends 90*a*, 90*b* so as to be centered about the axis 91 and includes three generally circular bore sections 99, 100, 101. Specifically, an upper bore section 99 extends inwardly from the first end 90*a* and is sized to receive a portion of the nozzle 46, and preferably includes a threaded section 99*a* threadably engageable by the nozzle 46. A relatively radially larger, lower bore section 101 extends inwardly from the body second end 90*b* and is sized to receive a portion of the support body 52. Further, a central bore section 100 extends between the upper and lower sections 99, 101 and is sized to receive a portion of the wear insert 50. As such, the second and third bore sections 100, 101 provide the coupler cavity 40 for removably connecting the cap member 54 with the wear insert 50 and the support body 52.

More specifically, the cap member body 90 is disposable about or over the connected wear insert 50 and support body 52 such that the wear insert body 58 extends into the second, central bore section 100 and an upper portion of the support member body 70 extends into the lower, radially larger bore section 101. Preferably, the cap member 54 is connected with the support body 52 by means of at least one dowel 102 (or set screw or other means) each extending from the cap body lower cylindrical section 96 and into a recess 103 in the support cylindrical body 70, as best shown in FIGS. 2 and 7. Further, the cap body 90 further preferably includes a pair of shoulders 104 extending radially into the bore lower section and engageable with radial side surfaces 72*a*, 72*b* of the support body rectangular mounting portion 72 so as to reinforce the support body 52 within the cap member 54 against the pressure of the fluid flow F. Furthermore, the cap body 90 also preferably includes an angled hole 106 extending through the body frustoconical main section 94 from the body outer surface to the central bore section 100 and providing the abrasive flow bore 44, as described above. Specifically, the angled hole 106 has a threaded section 107 and is sized to receive an end 48*a* of the abrasive supply tube assembly 48, such that a threaded portion 48*b* of the supply tube 48 engages the hole threaded section 107 to secure the abrasive supply tube 48 to the cap member 54. As such, the outlet 51 at the supply tube end 48*a* is positioned adjacent to the abrasive passage inlet port 36*a* of the wear insert 50.

Referring now to FIGS. 3 and 19-21, the orifice member 11 is preferably connected with the wear insert 50 and is configured to focus flow from the nozzle 46 into the high velocity fluid jet $J_F$ and to direct the fluid jet $J_F$ into the wear insert 50, as discussed above. The orifice member 11 is preferably provided as part of an orifice assembly 68 that further includes a mount 108. The orifice mount 108 is configured to support the orifice member 11, to connect the member 11 with the wear insert 50, and to position the orifice outlet 11*a* with respect to the focusing device inlet 26. The orifice member 11 includes a generally circular disk body 109 fabricated of a relatively hard material (e.g., diamond, sapphire, etc.) with a central through hole 109*a*. The through hole 109*a* has a narrow focusing passage section 111 providing the orifice inlet and outlet ports 11*b*, 11*a*, as discussed above and in further detail below. Preferably, the orifice mount 108 includes a complex-shaped base body 110 with first and second ends 110*a*, 110*b*, respectively, and a bore 112 extending between the two ends 110*a*, 110*b*. The focusing passage 111 includes an inlet port 114 providing the orifice member inlet 11*a* and fluidly coupleable with a source of high pressure fluid S, specifically through the preferred nozzle 46, and an outlet port 116 providing the orifice member outlet 11*a*. Further, the focusing passage 111 is configured to substantially increase velocity of the fluid F flowing therethrough so as to form the fluid jet $J_F$, as discussed above, which is then discharged through the outlet port 116.

Figure 22:
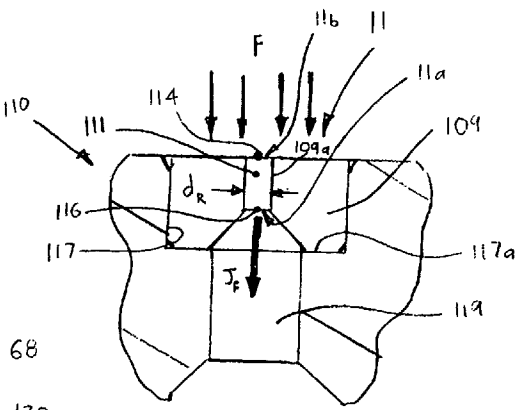
FIG. 22 is a broken-away, greatly enlarged cross-sectional view of an orifice member and orifice mount.
Figure 21:
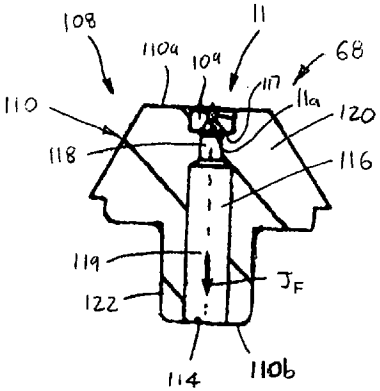
FIG. 21 is an axial cross-sectional view of the orifice assembly of FIG. 20.
Figure 19:
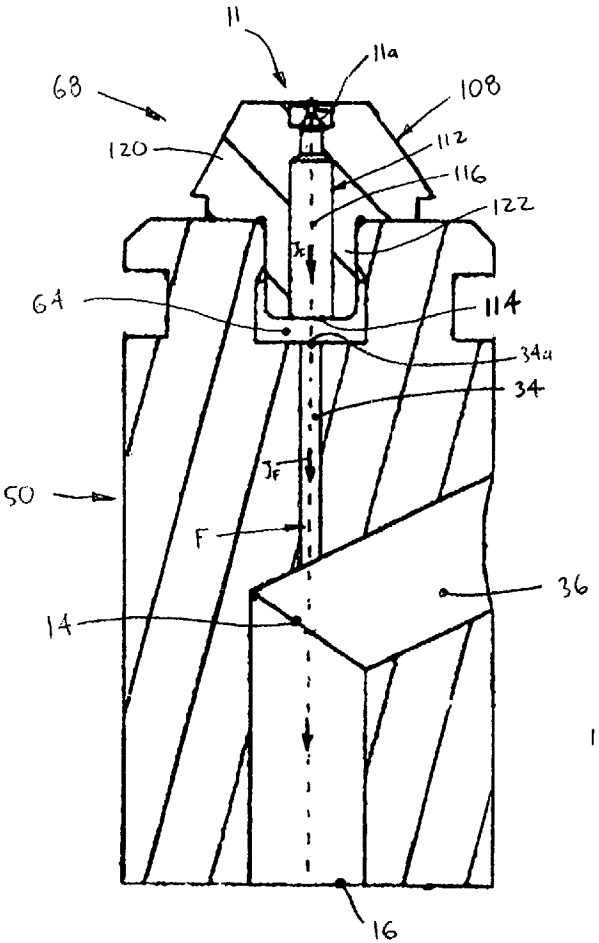
FIG. 19 is an enlarged, axial cross-sectional view of a wear insert and an orifice assembly of the cutting head.

More specifically, as best shown in FIG. 22, the orifice focusing passage 111 has a relatively small diameter $d_R$ and is sized so that high pressure flow F entering the passage inlet port 114 is significantly restricted, thereby substantially increasing the velocity thereof to form the jet $J_F$. Further, the mount bore 112 includes a circular mounting hole section 117 extending inwardly from the body first end 110*a* and having a radial shoulder surface 117*a* for supporting the orifice body 109, a central clearance hole section 118 extending inwardly from the mounting hole section 117, and a larger clearance section 119 extending from the central hole section 118 to the body lower end 110*b*. As such, the focusing passage 111 focuses the flow into the high velocity fluid jet $J_F$, and then the jet $J_F$ passes through the base clearance hole sections 118, 119 and into the wear insert jet inlet passage 34, as indicated in FIG. 19.

Further, the orifice mount body 110 preferably includes an upper, generally frustoconical main portion 120 and a lower generally cylindrical shaft portion 122. The body shaft portion 122 extends from a lower surface of the 120*a* of the main portion 120 and is disposable within the wear insert mounting cavity 64 to couple the orifice member with the wear insert 50, such that the main portion lower surface 120*a* is disposed against the wear insert body upper end 58*a*. When the orifice member 11 is coupled with the wear insert 50, the fluid jet $J_F$ passes generally directly from the orifice outlet 114 into the jet inlet passage 34. Further, as the orifice member 68 is mounted directly upon the wear insert 50, the orifice passage 116 and the wear insert jet inlet port 34*a* are directly alignable, which reduces tolerance stack-up and ensures more precise alignment in comparison with previously known orifice member and wear insert structures. Also, by mounting the orifice member 68 on the wear insert 50, the orifice member 68 is capable of applying a compressive force FC against the wear insert 50, generated by the nozzle 46 pushing against the orifice member 68, as indicated in FIG. 3. More specifically, the nozzle inner end 46*a* contacts and receives a section of the orifice member 68, such that the nozzle 46 may be advanced along the cap bore threaded section 99*a* to forcibly push against the orifice member 68 with the compressive force FC, thereby pushing the wear insert 50 against the support body shoulder surface 75*a*. As such, the compressive force FC functions to prevent rotation of the wear insert 50 in the event of a failure of the preferred set screw 83, thereby maintaining the wear insert abrasive inlet port 36*a* aligned with the abrasive supply tube outlet 51.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as generally defined in the appended claims.

We claim:

1. A fluid focusing device for a cutting head of a waterjet cutting machine, the cutting head including a base with a bore having a central axis extending through the bore and an orifice member coupled with the base, the orifice member having an outlet and a passage for increasing velocity of fluid flowing through the passage so as to form a fluid jet discharged through the outlet, the focusing device comprising:

an elongated, generally tubular body with a body axis and a central passage having an inlet port and a discharge port, the tubular body being at least partially disposeable within the base bore such that the body inlet port is fluidly coupleable with the orifice member outlet, the tubular body being configured so as to be separately positionable at each one of a finite number of discrete, predetermined angular positions about the base bore axis, the inlet port being at least generally aligned with the orifice member outlet at each one of the finite number of positions of the tubular body about the base bore axis such that the fluid jet flows from the orifice member outlet through the inlet port and into the central passage.

2. The fluid focusing device as recited in claim 1 wherein the tubular body has a plurality of indexing surfaces engageable with the base so as to position the tubular body separately at each one of the predetermined angular positions.

3. The fluid focusing device as recited in claim 1 wherein the cutting head base further has a mixing chamber disposed generally between the orifice member and the bore, the mixing chamber having an outlet, the inlet port of the tubular body being at least generally aligned with the mixing chamber outlet at each one of the plurality of positions of the tubular body about the base bore axis such that the fluid jet flows through the mixing chamber outlet and into the body inlet port.

4. The fluid focusing device as recited in claim 1 wherein the tubular body inlet port has a circumference and the body is adjustably positionable about the base bore axis so as to vary sections of the inlet port contactable by the fluid jet such that wear from misalignment between the mixing chamber outlet and the body inlet port is generally distributed about the circumference.

5. The fluid focusing device as recited in claim 1 wherein:

the base has at least one locator surface disposed at a specific angular position about the base bore axis; and the tubular body has at least first and second indexing surfaces each separately disposeable generally against the at least one locator surface, the first indexing surface being disposed against the at least one locator surface when the tubular body is located at a first angular position about the bore axis and the second indexing surface being disposed against the at least one locator surface when the tubular body is located at a second angular position about the bore axis.

6. The fluid focusing device as recited in claim 5 wherein, the base bore has a plurality of locator surfaces and the tubular body has a plurality of indexing surfaces, each indexing surface being disposeable against a separate one of the locator surfaces when the tubular body is disposed within the base bore.

7. The fluid focusing device as recited in claim 6 wherein the tubular body indexing surfaces are each separately disposeable against each one of the bore locator surfaces so as to variably locate the tubular body about the base bore axis.

8. The fluid focusing device as recited in claim 1 wherein the base bore is at least partially defined by an inner circumferential surface, the base bore inner circumferential surface having at least one inwardly offset locator section spaced generally toward the bore axis, a tubular body indexing surface being disposeable against the bore locator surface section so as to locate the tubular body at a particular angular position about the bore axis.

9. The fluid focusing device as recited in claim 1 wherein the tubular body has an inlet end defining the inlet port and at least one indexing surface disposed at least generally proximal to the body inlet end and configured to provide a visual indication of the angular position of the body about the bore axis.

10. The fluid focusing device as recited in claim 9 wherein the tubular body has a plurality of indexing surfaces circumferentially spaced about the body axis.

11. A cutting head for a waterjet cutting machine, the cutting head comprising:

a base with a bore and a central axis extending through the bore;

an orifice member coupled with the base and having an inlet, an outlet, and a passage extending between the inlet and outlet, the passage being configured to increase velocity of fluid flowing through the passage so as to form a fluid jet discharged through the orifice member outlet and generally toward the base bore; and a fluid focusing device including a generally tubular body with a central passage having an inlet port and a discharge port, the tubular body being at least partially disposeable within the base bore such that the body inlet port is fluidly coupleable with the orifice member outlet, at least one of the tubular body and the base being configured such that the tubular body is separately positionable at one of a finite number of discrete, predetermined angular positions about the base bore axis, the body inlet port being at least generally aligned with the orifice member outlet at each one of the finite number of positions of the body about the axis such that the fluid jet flows from the orifice member outlet through the inlet port and into the central passage.

12. The cutting head as recited in claim 11 wherein the base further has a mixing chamber disposed generally between the orifice member and the bore, the mixing chamber having an outlet, the inlet port of the tubular body being at least generally aligned with the mixing chamber outlet at each one of the plurality of positions of the body about the body axis such that the fluid jet flows through the mixing chamber outlet and into the body inlet port.

13. The cutting head as recited in claim 11 wherein:

the base has at least one locator surface disposed at a specific angular position about the bore axis; and the tubular body has at least a first indexing surface and a second indexing surface, each separately disposeable generally against the at least one locator surface, the first indexing surface being disposed against the at least one locator surface when the tubular body is located at a first angular position about the bore axis and the second indexing surface being disposed against the at least one locator surface when the tubular body is located at a second angular position about the bore axis.

14. The cutting head as recited in claim 13 wherein contact between at least the first indexing surface and the at least one locator surface prevents rotation of the focusing body about the bore axis.

15. The cutting head as recited in claim 11 wherein:

the base has a plurality of locator surfaces spaced circumferentially about the bore axis; and the tubular body has a body axis and a plurality of indexing surfaces spaced circumferentially about the body axis, each indexing surface being disposeable against a separate one of the locator surfaces when the tubular body is disposed within the bore, a number of the indexing surfaces being equal to a number of the locator surfaces, each indexing surface being disposed against a particular one of the locator surfaces in one of the predetermined angular positions and disposed against another one of the locator surfaces in another one of the predetermined angular positions.

16. The cutting head as recited in claim 15 wherein contact between at least one of the indexing surfaces and one of the locator surfaces disposed against the indexing surface prevents rotation of the focusing body about the bore axis.

17. The cutting head as recited in claim 15 wherein the indexing surfaces are each separately disposeable against each one of the locator surfaces so as to variably locate the tubular body about the body axis.

18. The cutting head as recited in claim 15 wherein the base bore is at least partially defined by a generally polygonal inner surface extending circumferentially about the bore axis, the polygonal surface having a plurality of surface sections spaced circumferentially about the bore axis and each providing a separate one of the locator surfaces; and the tubular body has a a generally polygonal outer surface extending circumferentially about the body axis, the polygonal outer surface having a plurality of surface sections spaced circumferentially about the body axis and each providing a separate one of the indexing surfaces, the tubular body polygonal outer surface being disposeable generally within the base bore polygonal inner surface when the tubular body is disposed within the base bore.

19. The cutting head as recited in claim 15 wherein:

the base has first and second ends, the bore extending generally between the two ends, the locator surfaces being located at least generally proximal to the body first end; and the tubular body has first and second ends, the indexing surfaces being located at least generally proximal to the body first end, the body being insertable into the bore through the base second end until the indexing surfaces are disposed within the locator surfaces.

20. The cutting head as recited in claim 19 wherein the tubular body is removable from the base bore through the base second end, rotatable about the body axis, and reinsertable through the base second end until each body indexing surface is disposed against a separate one of the base locator surfaces.

21. The cutting head as recited in claim 19 wherein:

the base bore has a generally circular inner circumferential surface extending about the bore axis and axially between the locator surfaces and the base second end; and the tubular body has an outer circumferential surface extending axially between the indexing surfaces and the body second end, a portion of the focusing device outer circumferential surface being disposed generally within the base bore inner circumferential surface and the body second end being spaced from the base second end when the focusing device is disposed within the base bore.

22. The cutting head as recited in claim 11 wherein the base includes:

a first base portion including the base bore; and a second base portion removably connected with the first base portion and configured to receive the orifice member.

23. The cutting head as recited in claim 22 wherein the second base portion includes a mixing chamber and a chamber outlet passage and is configured to support the orifice member such that the mixing chamber is located generally between the orifice member and the first base portion and the chamber outlet is disposed proximal to the inlet port of the tubular body.

24. The cutting head as recited in claim 22 wherein:

the second base portion further includes a jet inlet passage and an abrasive material flow passage, each of the two passages being fluidly connected with the mixing chamber; and the base further includes a third base portion removably connected with at least one of the first and second base portions, the third base portion including a cavity configured to receive the second base portion and at least a portion of the first base portion, a nozzle bore fluidly coupleable with the jet inlet passage and an abrasive flow bore at least generally alignable with the abrasive flow passage.

25. The cutting head as recited in claim 24 wherein:

the third base portion further has a first end and a second end, the cavity extending inwardly from the second end and the nozzle bore extending from the first end to the cavity; and the cutting head further comprises a fluid supply nozzle fluidly connected with a high pressure fluid source and at least partially disposed within the nozzle bore and an abrasive supply tube fluidly connected with a source of abrasive material and at least partially disposed within the abrasive flow bore.

26. The cutting head as recited in claim 11 wherein the base includes:

a cylindrical wear insert including a first end and a second end, an interior chamber providing the mixing chamber, a jet inlet passage extending from the first end to the mixing chamber, the outlet extending from the mixing chamber to the second end; and a generally cylindrical support member having first and second ends and a through hole extending between the support member first and second ends and providing the base bore, the tubular body being disposeable within the support member through hole and the wear insert second end being coupleable with the support member first end so as to generally align the mixing chamber outlet with the tubular body inlet port.

27. The cutting head as recited in claim 11 wherein:

the base bore is at least partially defined by a generally polygonal inner surface extending circumferentially about the bore axis, the polygonal inner surface having a plurality of locator surface sections spaced circumferentially about the bore axis; and the tubular body has a body axis and a generally polygonal outer surface extending circumferentially about the axis, the polygonal outer surface having a plurality of indexing surface sections spaced circumferentially about the body axis, each indexing surface being disposed against a separate one of the locator surfaces when the tubular body is disposed within the bore.

28. The cutting head as recited in claim 27 wherein:

the base has an end and an opening located at the end, the bore polygonal inner surface is spaced along the bore axis from the end, and the base bore is further defined by a generally circular inner surface extending circumferentially about the bore axis and axially between the polygonal inner surface and the base end opening; and the tubular body further has opposing first and second ends, the inlet port extending through the first end, the outlet port extending through the second end, and the polygonal outer surface being located at least generally proximal to the body first end, and an outer circular surface extending circumferentially about the body axis and axially between the polygonal outer surface and the body second end, the tubular body being insertable into the base end opening and displaceable along the body axis until the tubular body outer polygonal surface is generally disposed within the base bore inner polygonal surface and at least a portion of the tubular body circular outer surface is disposed within the bore circular inner surface.

29. The cutting head as recited in claim 11 wherein:

the base bore includes a first, generally polygonal inner surface section located at least generally proximal to the orifice member inlet and a second, generally circular inner circumferential surface section; and the tubular body has a generally polygonal outer surface section, the body polygonal outer surface section being disposeable within the base bore polygonal inner surface section and providing the indexing surfaces, and a generally circular outer section disposeable within the base bore circular inner surface section.

30. The cutting head as recited in claim 29 wherein the bore polygonal inner surface section and the body polygonal outer surface section are generally rectangular.

31. The cutting head as recited in claim 11 wherein the tubular body has an inlet end defining the inlet and at least one indexing surface disposed at least generally proximal to the body inlet end and configured to provide a visual indication of the angular position of the body about the bore axis.

32. The cutting head as recited in claim 31 wherein the tubular body has a plurality of indexing surfaces circumferentially spaced about the body axis.

33. The cutting head as recited in claim 11 wherein:

the base includes first and second, removably connected base portions, the first base portion being configured to support the orifice member and the second base portion providing the base bore; and the tubular body has a first, inlet end and a second, discharge end, the body inlet end being disposed within the second base portion so as to be generally visible when the first and second base portions are separate from each other, the body inlet end being configured to provide a visual indication of the angular position of the tubular body about the base bore axis.

34. The cutting head as recited in claim 11 wherein the base bore is at least partially defined by an inner circumferential surface, the base bore inner surface having at least one inwardly offset locator section spaced generally toward the bore axis, the tubular body indexing surface being disposeable against the locator section so as to locate the tubular body at a particular angular position about the bore axis.

35. The cutting head as recited in claim 11 wherein:

the base is connectable with a source of high-pressure fluid such that fluid flows into the orifice member inlet, through the orifice passage, and out of the orifice member outlet; and the tubular body inlet port has a circumference and is generally alignable with the orifice member outlet such that high pressure fluid flows out of the orifice outlet and into the tubular body central passage, the body being adjustably positionable about the bore axis so as to vary sections of the body inlet port contactable by the fluid flow such that wear from misalignment between the chamber outlet and body inlet port is generally distributed about the inlet circumference.

36. A wear insert for a cutting head of a water jet cutting machine, the cutting head including a base with a bore, a generally tubular fluid focusing device disposed at least partially within the base bore and having a central passage with an inlet port and a discharge port, and an orifice member connected with the base and having a central passage and an orifice member outlet, the wear insert comprising:

a generally cylindrical body connectable with the base and having a first end and a second end, a passage extending between the first end and the second, and an outlet at the second end, the outlet being disposed generally proximal to the inlet port and the first end being configured to support the orifice member such that fluid flow through the orifice member passage flows out of the orifice member outlet, through the insert body passage and the insert body outlet, and into the inlet port, wherein the cylindrical body passage includes an interior mixing chamber, a jet inlet passage section extending generally between the first end and the mixing chamber, and an outlet passage section extending between the mixing chamber and the insert body outlet, the cylindrical body further has an outer surface and an abrasive stream passage extending generally between the outer surface and the mixing chamber.

37. The wear insert as recited in claim 36 wherein the base bore includes a mounting cavity section, a portion of the wear insert body second end is disposed within the mounting cavity section such that the wear insert outlet is located generally adjacent to the focusing device inlet port, and the wear insert has a mounting cavity extending into the body first end and configured to receive a portion of the orifice member such that the orifice member outlet is generally aligned with the focusing device inlet port.

38. The wear insert as recited in claim 37 wherein the cutting head includes an orifice mount for supporting the orifice member, the wear insert mounting cavity member being configured to receive a portion of the orifice mount so as to connect the orifice member with the wear insert.

39. A cutting head for a water jet cutting machine, the cutting head comprising:

a base with a bore;

a fluid focusing device including a generally tubular body with a central passage having an inlet port and a discharge port, the tubular body being at least partially disposeable within the base bore;

an orifice member having a passage with an outlet, the passage being configured to increase velocity of fluid flowing through the passage so as to form a fluid jet discharged through the outlet; and a wear insert with a generally cylindrical body with a first end and a second end, a passage extending between the first end and the second, and a body outlet at the second end, the second end being connectable with the base such that the body outlet is disposed generally proximal to the tubular body inlet and the first end being configured to support the orifice member such that the fluid jet from orifice member outlet flows through the insert body passage and the body outlet and into the focusing device inlet port.

40. The cutting head as recited in claim 39 wherein the wear insert passage includes an interior mixing chamber, a jet inlet passage section extending generally between the first end and the mixing chamber, and an outlet passage section extending between the mixing chamber and the body outlet.

41. The cutting head as recited in claim 39 wherein the wear insert body further has an outer surface and an abrasive stream passage extending generally between the outer surface and the mixing chamber.

42. The cutting head as recited in claim 41 further comprising an abrasive supply line having an inlet end connectable with a source of abrasive material and an outlet end disposed at least generally proximal to the wear insert outer surface such that abrasive material flows from the supply line outlet end generally directly into the wear insert abrasive flow passage.

43. The cutting head as recited in claim 39 wherein the wear insert further includes an interior mixing chamber, a jet inlet fluidly connectable with the orifice member outlet and extending to the mixing chamber, and an abrasive stream inlet fluidly connectable with a source of abrasive material and extending to the mixing chamber.

44. The cutting head as recited in claim 39 wherein:

the base includes a mounting cavity section configured to receive a portion of the wear insert body second end such that the wear insert outlet is located generally adjacent to the focusing device inlet port; and the wear insert body first end has a mounting cavity extending into the body first end and configured to receive a portion of the orifice member such that the orifice member outlet is generally aligned with the focusing device inlet port.

45. The cutting head as recited in claim 44 wherein the wear insert passage includes an interior mixing chamber, a jet inlet passage section extending generally between the mounting cavity and the passage and the mixing chamber, and an outlet passage section extending between the mixing chamber and the insert body, the orifice outlet being fluidly coupled with the focusing device inlet port at least partially by the wear insert jet inlet passage, the mixing chamber, and the wear insert outlet passage.

46. The cutting head as recited in claim 44 further comprising an orifice mount configured to support the orifice member and to connect the orifice member with the wear insert so as to position the orifice member outlet with respect to the focusing device inlet.

47. The cutting head as recited in claim 46 wherein:

the orifice mount has a main body portion with an outer contact surface section and a coupler portion extending outwardly from the main body portion surface section; and the wear insert body outer surface has a support surface section extending about the wear insert mounting cavity, the orifice mount coupler portion being disposeable within the wear insert mounting cavity such that the orifice mount contact surface is disposeable against the wear insert base surface.

48. The cutting head as recited in claim 39 wherein the base bore has a main section configured to receive the focusing device and a coupler section extending between the base first end and the bore main section, the bore coupler section being configured to receive the wear insert second end so as to couple the wear insert with the base.

49. The cutting head as recited in claim 39 wherein the orifice member has a body providing the orifice passage and orifice outlet and further having an inlet, the inlet being fluidly coupleable with a source of high pressure fluid.

50. The cutting head as recited in claim 39 further comprising a cap member with a cavity configured to receive the wear insert and connectable with the base member such that the wear insert is disposed within the cap cavity, a substantial portion of the wear insert being visually inspectable while connected with the base when the cap member is separate from the base.

51. The cutting head as recited in claim 50 wherein:

the cap further has a first end and a second end, the cavity extending inwardly from the second end toward the first end, and a nozzle bore extending between the first end and the cavity; and the cutting head further comprises a nozzle connectable with a source of high pressure fluid, disposeable within the cap bore, and having an inner end disposeable generally against the orifice member such that the nozzle retains the wear insert disposed against the base through contact with the orifice member so as to substantially prevent vibration of the wear insert.

52. A cutting head for a waterjet cutting machine, the cutting head comprising:

a base with a mixing chamber having an outlet and a bore aligned with the chamber outlet and having a central axis extending through the bore, a generally tubular body with a central passage having an inlet port and a discharge port, the tubular body being disposeable within the base bore such that the body inlet port is fluidly coupleable with the mixing chamber outlet, at least one of the tubular body and the base being configured to indicate the angular position of the tubular body about the base bore axis at at least one of a finite number of discrete, pre-determined angular positions.

* * * * *

UNITED STATES PATENT AND TRADEMARK OFFICE

CERTIFICATE OF CORRECTION

PATENT NO. : 7,922,566 B2
APPLICATION NO. : 11/888688
DATED : April 12, 2011
INVENTOR(S) : Shajan V. Chacko It is certified that error appears in the above-identified patent and that said Letters Patent is hereby corrected as shown below:

In claim 18, column 13, line 32, the word "inner" is missing. It should be between the words "polygonal" and "surface."

Signed and Sealed this
Seventeenth Day of January, 2012

David J. Kappos

David J. Kappos
*Director of the United States Patent and Trademark Office*